US008980014B2

(12) United States Patent
Classen et al.

(10) Patent No.: US 8,980,014 B2
(45) **Date of Patent: *Mar. 17, 2015**

(54) CARTRIDGE AND WATER-CONDUCTING DOMESTIC APPLIANCE COMPRISING A DETERGENT DOSING SYSTEM FOR A CARTRIDGE

(75) Inventors: Egbert Classen, Wertingen (DE); Helmut Jerg, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1260 days.

This patent is subject to a terminal disclaimer.

(21) Appl. No.: 12/311,095

(22) PCT Filed: Aug. 29, 2007

(86) PCT No.: PCT/EP2007/058997

§ 371 (c)(1),
(2), (4) Date: Mar. 18, 2009

(87) PCT Pub. No.: WO2008/034698

PCT Pub. Date: Mar. 27, 2008

(65) Prior Publication Data

US 2010/0012161 A1 Jan. 21, 2010

(30) Foreign Application Priority Data

Sep. 19, 2006 (DE) ..... 10 2006 043 976

(51) Int. Cl.
*B08B 3/00* (2006.01)
*B08B 3/12* (2006.01)
(Continued)

(52) U.S. Cl.
CPC ..... *A47L 15/4463* (2013.01); *A47L 15/44* (2013.01); *A47L 15/4445* (2013.01);
(Continued)

(58) Field of Classification Search
CPC . A47L 15/44; A47L 15/4409; A47L 15/4418; A47L 15/4445; A47L 15/4454; A47L 15/4463; A47L 15/4472; A47L 15/449; B08B 3/04; B08B 3/02
USPC ..... 134/18, 25.2, 56 R, 57 D, 56 D, 58 D
See application file for complete search history.

(56) References Cited

U.S. PATENT DOCUMENTS 3,166,096 A * 1/1965 Lang ..... 137/564.5
4,212,373 A * 7/1980 Scragg ..... 184/39.1
(Continued)

FOREIGN PATENT DOCUMENTS

DE 1938198 U 5/1966
DE 102005061801 A1 6/2007
(Continued)

*Primary Examiner* — Alexander Markoff
(74) *Attorney, Agent, or Firm* — James E. Howard; Andre Pallapies

(57) ABSTRACT

A cartridge for use in a detergent-dosing system of a water-conducting domestic appliance, in particular, a cartridge for use in a domestic dishwasher of the type having a detergent dispenser configured with a holding space for holding the cartridge, the cartridge including at least a pair of chambers, each chamber for holding a detergent separate from any detergent held by another chamber; and a pair of seals, each seal being associated with a respective one of the chambers for substantially precluding discharge of a detergent retained by the respective chamber and each seal being configured to be opened at least once for a discharge of detergent from the respective chamber and to be closed again at least once.

27 Claims, 3 Drawing Sheets

(51) Int. Cl.
*B08B 7/00* (2006.01)
*A47L 15/44* (2006.01)

(52) U.S. Cl.
CPC ..... *A47L 15/4454* (2013.01); *A47L 15/4418* (2013.01); *A47L 15/449* (2013.01); *A47L 15/4409* (2013.01); *A47L 15/4472* (2013.01)
USPC .... 134/58 D; 134/56 D; 134/57 D; 134/57 R; 134/18; 134/25.2

(56) References Cited

U.S. PATENT DOCUMENTS 6,138,693 A * 10/2000 Matz ..... 134/57 D
6,142,750 A * 11/2000 Benecke ..... 417/411
2002/0088502 A1 7/2002 Van Rompuy et al.
2002/0108969 A1 * 8/2002 Rodd et al. ..... 222/209
2005/0000551 A1 1/2005 McIntyre et al.
2005/0126608 A1 6/2005 DeWeerd et al.
2007/0144558 A1 6/2007 Classen et al.
2008/0277370 A1 * 11/2008 Mikkelsen ..... 215/247

FOREIGN PATENT DOCUMENTS

EP 1281346 A1 2/2003
WO 9523549 9/1995
WO 0220893 A1 3/2002
WO 0229150 A1 4/2002
WO WO 2005058126 A1 * 6/2005

* cited by examiner

CARTRIDGE AND WATER-CONDUCTING DOMESTIC APPLIANCE COMPRISING A DETERGENT DOSING SYSTEM FOR A CARTRIDGE

BACKGROUND OF THE INVENTION

The invention relates to a cartridge according to the preamble of claim 1. The invention relates further to a water-conducting domestic appliance having a detergent-dosing system.

The majority of domestic dishwashers for example currently in use have an adding device for holding one or more detergents that is/are added to the washing liquor during a washing cycle for cleaning the items arranged in the dishwasher for washing. The detergent held in store in the adding device is usually fully dispensed into the washing compartment during the washing cycle and mixed with the washing liquor being circulated therein. In terms of its size the adding device is dimensioned such that it can be filled just with the amount of detergent required for one washing cycle. The person using the dishwasher is therefore obliged at the beginning of each washing cycle to fill the adding device with the amount of detergents required for that cycle. That manner of handling is inconvenient for the dishwasher user. With said type of dishwashers there is also the problem that the amount of detergent with which the adding device is filled can vary from user to user and also from washing cycle to washing cycle. An incorrectly dosed amount of detergent can result on the one hand in unsatisfactory washing results if too little detergent has been dosed and, on the other, in the wasting of detergent and hence stressing of the environment if too much detergent has been dosed.

Adding devices that add the amount of detergent stored in them to the washing liquor all at once will furthermore not allow more complex washing programs to be executed. Thus, for example, it can be expedient in certain situations to add doses of the detergent to the washing liquor at different times.

Adding devices that are embodied for holding a single dose of detergent cannot support complex washing cycles of said kind.

Using a container or cartridge in a detergent-dosing system entails the problem that any detergent residues remaining in the container or cartridge may escape from it when it is removed from the detergent-dosing system. Depending on what substances they contain, detergents that escape could pose a health hazard to persons coming into contact with them.

BRIEF SUMMARY OF THE INVENTION

It is hence an object of the present invention to disclose a cartridge and a water-conducting domestic appliance that do not have the above-cited disadvantage. It is a further object of the invention to disclose a detergent-dosing system.

Said object is achieved by means of an inventive cartridge having the features of claim 1. Advantageous embodiments will emerge from the dependent claims.

The inventive cartridge for use in a detergent-dosing system of a water-conducting domestic appliance, in particular a domestic dishwasher, has at least one detergent dispenser that has a holding space for holding at least one cartridge, the cartridge having separate chambers each for holding at least one detergent. It is therein inventively provided for the chambers to be joined to at least one seal that can be opened and closed again at least once. Because the cartridge has to be opened once only on being inserted into a detergent-dosing system and closed once only on being removed from a detergent-dosing system, it is preferably provided for the seal to be embodied for being opened once only and closed once only.

It is therein preferably provided for the seal to be embodied for respectively opening and closing automatically when the cartridge is inserted into and removed from a detergent-dosing system. The seal serves to prevent the detergent held in store in the cartridge from unintentionally escaping during storage and transportation. The seal will be opened the instant the cartridge is inserted into the detergent-dosing system's detergent dispenser so that the detergent can be added in doses to the washing liquor during the dishwasher's further operation. With the cartridge installed in position in the detergent-dosing system the openable seal can be located, for example, in the direction of gravity at the bottom, meaning in the cartridge's base. That will make it easier for the cartridge to empty completely in its installed position, as a result of which no detergent will remain unused in the cartridge. It can be ensured that no detergent can escape from the cartridge when it has been removed from the detergent-dosing system. A cartridge that is particularly simple in its structural design and economical to produce will result if the openable seal is formed by means of a membrane, a film or an elastomer. If the cartridge is made of, for instance, a plastic material, then the cartridge along with the openable seal can be produced in one step by means of a two-component injection-molding process.

An inventive cartridge preferably has at least one seal which, with the cartridge inserted into the detergent-dosing system, will be positioned such as to correspond to an opening means of the detergent-dosing system so that the openable seal will have been put into an opened position in which the detergent can be added during a washing cycle, in particular by the detergent-dosing system.

The inventive cartridge is provided with an openable seal that can be opened automatically when the cartridge is inserted into the detergent-dosing system and closed automatically when the cartridge is removed from the detergent-dosing system. When the cartridge is inserted into the detergent-dosing system the openable seal will be located at a place corresponding to a hollow needle of the detergent-dosing system so that the openable seal will be pierced by said needle. The hollow needle is therein provided in a stationary manner in the detergent-dosing system. Detergent can hence reach the detergent-dosing system via the hollow needle during a washing cycle and be added to the washing liquor in doses by said system. When, conversely, the cartridge is removed from the detergent-dosing system, the opening produced by the hollow needle will close owing to the openable seal's elastic properties so that any detergent residues in the cartridge will be prevented from escaping. A seal that can be re-closed at least once will be provided thereby by the simplest means.

The number of openable seals on the cartridge corresponds in one embodiment to the number of detergents held in store in the cartridge or to a number of chambers holding the detergents.

The at least one detergent is held in store in respective chambers in the cartridge, with a ventilating chamber further being provided that is functionally linked to the chambers. Holding different detergents in store in different chambers has the advantage that at a certain part of the washing cycle only the specific detergent necessary for that part will need to be added. It is therein of course also possible for a plurality of the detergents to be added simultaneously during a certain part of a washing cycle. It is furthermore possible to locate a plurality of detergents in a common chamber in the cartridge.

The ventilating chamber ensures that no negative pressure that would impede the adding of detergent can occur in the respective chambers holding detergent as they are increasingly emptied.

It is therein particularly provided for the ventilating chamber to be functionally linked via ventilating channels provided in a common cover closing the individual chambers to the chambers holding the detergents. The cover will be located in the direction of gravity at the top when the cartridge is located in the detergent-dosing system. That will ensure that air can flow into the respective chambers in the cartridge as they are increasingly emptied and that the respective detergents can exit or be added in doses simply and precisely.

The cartridge can furthermore have at least one conveying device by means of which at least one detergent can be conveyed, in particular via the detergent-dosing system, into the dishwasher's washing compartment, for example. The conveying device can be embodied in the form of, for instance, a pump. The detergents can, though, also be conveyed into the dishwasher's washing compartment under gravity, the conveying device in that case embodying the function of a valve that will allow washing agents to exit the respective chambers in the cartridge or prevent them from exiting. In particular a number of conveying devices can therein be provided that corresponds to the number of detergents.

To prevent the cartridge from being inserted into the detergent dispenser incorrectly, the cartridge's housing has a mechanical coding formed by means of, for instance, projections or guides. The coding is embodied such that the cartridge can be inserted into the detergent dispenser in a single manner only, namely the predefined manner. It will thereby be ensured that the openable seal can be positioned such as to correspond to the detergent-dosing system's opening means.

The cartridge can have any suitable shape. It is, though, preferably provided for the cartridge's housing to have a longitudinal extent along a main axis. It can be, for example, a cuboid basic body having a longitudinal axis—along the width, for example—that is substantially longer than all other axes (along the depth and height). It can, though, also be a conical, cylindrical or pyramidal basic body or one shaped like a truncated cone or truncated pyramid having a main axis.

It is therein preferable for the main axis to be longer than secondary axes of the housing having one of the above-cited basic shapes of the cartridge, for example by a factor of at least 1.5. The basic body can furthermore preferably have an extent along a first secondary axis, for example along the height, and an extent along a second secondary axis, for example along the depth, with the extent along the first secondary axis being substantially longer than the extent along the second secondary axis, for example by a factor of 5 to 10, preferably 5. The cartridge will be particularly easy to handle and respective detergents will have a particularly practical volume if the cartridge's housing has a cuboid basic shape with a depth of around 25 mm, a width of around 200 mm and a height of around 125 mm. The preferred total number z of washing cycles between 20 and 40, preferably 30, can in particular be realized with dimensions of said kind.

In a preferred development it is provided for the cartridge's chambers to be arranged adjacently along the main axis. That means that in the case of a cartridge having a cuboid basic shape and a main axis extending in the direction of the width, the division into chambers results in chamber dimensions where the dimension of one chamber is a width portion corresponding to the number of chambers while an equal depth and height is provided for all chambers.

It is finally preferably provided for at least one of the chambers to have at least one of the following substances as its contents: Alkali-bearing substances, for example lye; complexing and dispersing agents, for example polymers; enzymes such as amylase, protease or lipase; bleaching agents, for example hydrogen peroxide; bleach activators and tensides such as, for example, nonionic tensides. A store of biocidal fluid can furthermore be additionally held. Biocides that counteract bacteria (bactericides), fungi (fungicides), microbes (microbicides), viruses (virucides) and also algae (algicides) can in particular be held in store, the addition of which biocides will prevent unpleasant odors from developing owing to, for example, the formation of biofilms during extended periods of non-operation.

The invention further includes a water-conducting domestic appliance, in particular a domestic dishwasher that has a detergent-dosing system, and is characterized in that the detergent-dosing system has a detergent dispenser having at least one holding space for holding at least one cartridge having at least one openable seal, and in that opening means are arranged such that the at least one seal will have been put into an opened position when at least one cartridge has been inserted. The detergent-dosing system can therein be embodied as bordering a washing compartment of the dishwasher inside the dishwasher. The detergent dispenser has a holding space for at least one cartridge containing at least one detergent, with the amount of detergent held in store being greater than the amount required for a washing cycle. The detergent-dosing system therein makes exactly the amount of detergent available that is necessary for one washing cycle.

The inventive detergent-dosing system hence includes as main components a detergent dispenser arranged inside the dishwasher in a stationary manner and at least one cartridge that contains detergent.

The detergent-dosing system's opening means therein performs the function of freeing access to the cartridge as soon as it has been inserted into the detergent-dosing system's detergent dispenser. The same advantages are incidentally associated therewith as those already explained in the foregoing.

The inventive detergent-dosing system's opening means is formed by means of a hollow needle, with the openable seal being located at a place corresponding to the hollow needle when at least one cartridge has been inserted into the detergent-dosing system so that the seal of the at least one cartridge will be pierced by said needle. It is obvious that if there are a plurality of openable seals a matching number of correspondingly arranged hollow needles will be provided that in each case cause the relevant seal to be pierced. It can also be provided independently thereof for an openable seal to be assigned a plurality of opening means, in particular hollow needles. For example the volume flow within a specific time can be influenced thereby without any special controlling.

To be able to ensure a corresponding positioning of the at least one cartridge relative to the detergent dispenser's opening means, the detergent-dosing system includes a retention device for securing the cartridge and fixing it in position. The retention device is in one embodiment variant formed by means of a receptacle, on a cover of the detergent dispenser, that can be moved, in particular swivelled, between an open position and a closed position and closes the holding space in the closed position. Apart from securing the cartridge in its correct position in keeping with its intended purpose, that will ensure that a cartridge will be easier to insert and, when empty, replace. The receptacle can be formed by means of, for example, retaining clips embodied as L-shaped on the cover, with in each case first sections of the retaining clips extending approximately perpendicularly away from a main surface of the cover and second sections being located on the ends, facing away from the main surface, of the first sections and extending approximately perpendicularly thereto, while ends facing away from the first sections face each other.

The detergent-dosing system can furthermore have a positioning device for positioning the at least one cartridge in the detergent dispenser, which device will compel the cartridge to adopt a predefined seating in the detergent-dosing system when the cartridge is located in the holding space. It can be ensured by means of the device for positioning the at least one cartridge that the corresponding arrangement of openable seals and opening means of the detergent dispenser in keeping with their intended purpose will be maintained. That will ensure the adding of doses of the detergent in keeping with the intended purpose.

In another embodiment variant it is provided for the detergent-dosing system to have at least one outlet that is functionally linked to the washing compartment and via which a specified amount of detergent can be ducted to the washing liquor during a washing cycle, with the at least one outlet being provided on the detergent dispenser. It is expedient for the at least one outlet to be provided on the detergent dispenser's housing section that is located in the direction of gravity below the holding space. A number of outlets can therein be provided that corresponds to the number of detergents held in store in the cartridge or to the number of chambers holding the detergents.

The detergent-dosing system's at least one outlet feeds into a dosing chamber that is functionally linked to the detergent. That means that the dosing chamber is linked to the detergent via the opening means or the hollow needle and possibly a controllable valve or suchlike. The dosing chamber can be assigned a conveying device by means of which the detergent can be ducted out of the cartridge to the washing compartment. The conveying device is expediently located in the dosing chamber. Dosing can be performed by means of, for example, a pump. Dispensing can alternatively take place by way of gravity and dosing by way of specifying a length of exiting time. With that variant, the openable seal will have to be located in the direction of gravity at the bottom when the cartridge has been inserted into the detergent-dosing system, which is incidentally a preferred arrangement.

The inventive detergent-dosing system can furthermore have at least one further chamber for a solid detergent. Providing a further chamber of said type has the advantage of ensuring that the dishwasher can also be operated if the at least one cartridge no longer contains any detergents and the user has no more filled cartridges to hand.

The detergent-dosing system is preferably arranged such as to be accessible to an operator only when the door is open. Thus the detergent-dosing system is according to one variant located in a side wall of the washing compartment between a top basket and a bottom basket of the dishwasher. The detergent-dosing system can alternatively be located on a dishwasher door embodied as able to swivel with respect to the washing compartment. The embodiment is in that variant provided on the door such that the detergent dispenser will be fitted with the cartridge from the door's front side. It can therein be fitted in the region of a cover panel on the door or of an inner door of the dishwasher's door.

The invention further includes a detergent-dosing system.

BRIEF DESCRIPTION OF THE DRAWINGS

The invention is explained in more detail below with reference to the figures, in which.

DETAILED DESCRIPTION OF THE PRESENT INVENTION

Figure 1:
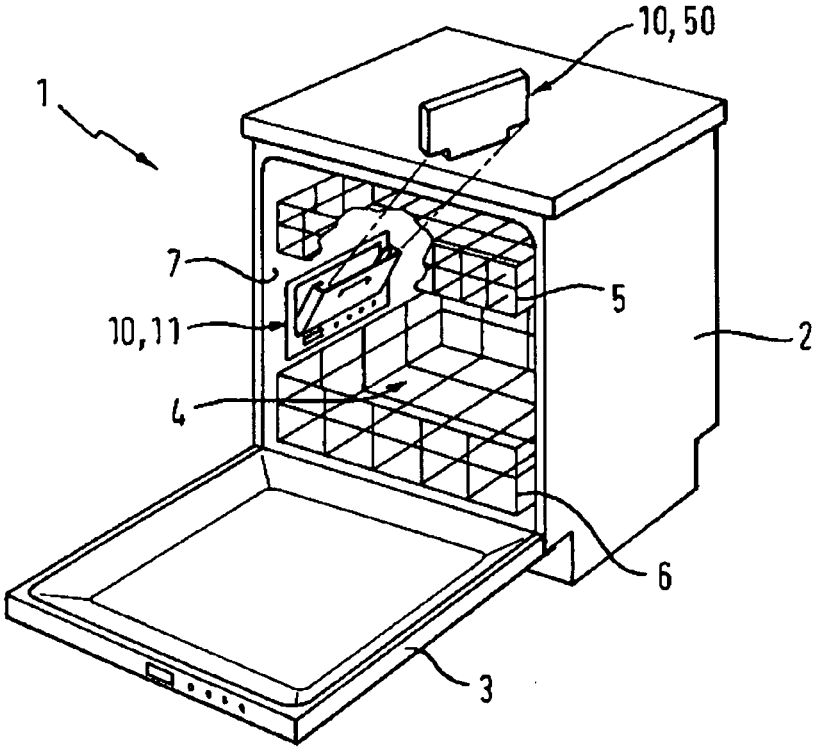
FIG. 1 shows an inventive dishwasher having a detergent-dosing system located in a container wall.

FIG. 1 shows an inventive dishwasher 1 having a door 3 attached in a swivelable manner to a housing 2. The door 3 is shown in its open position in the figure. Dishwasher baskets 5, 6 are in a known manner located in a washing compartment 4 that can be closed by means of the door 3. A detergent-dosing system 10 that includes a detergent dispenser 11 and a cartridge 50 that contains at least two detergents held in store separately from each other is located in a container wall 7 of the housing 2. FIG. 1 shows what is the preferred arrangement of the detergent-dosing system 10 between the top basket 5 and bottom basket 6. The detergent dispenser 11 holding the cartridge 50 is therein located in a section, close to the door opening, of the container wall 7 to make it easier for the user to insert the cartridge 50 into the detergent dispenser 11 and remove it therefrom.

Figure 3:
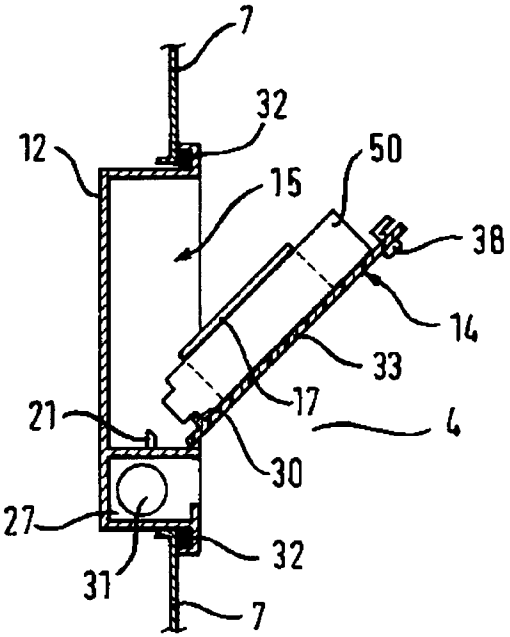
FIG. 3 is a cross-section through the detergent-dosing system shown in FIG. 3.
Figure 2:
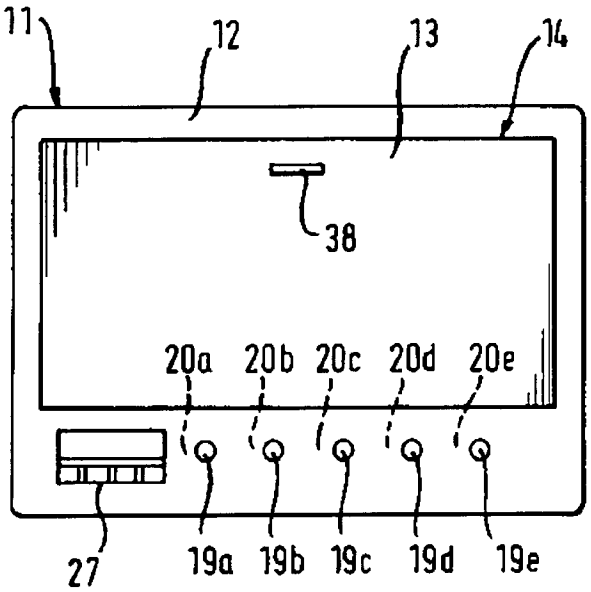
FIG. 2 is a top view of an inventive detergent-dosing system for locating in the dishwasher's container wall.

FIGS. 2 and 3 are respectively a top view of the detergent-dosing system 10 as used in the dishwasher shown in FIG. 1 and a cross-section through it. FIG. 2 shows the detergent dispenser 11 located in the container wall. Said dispenser includes a housing 12 and a cover 14 that is attached able to swivel with respect to the housing 12. When, as shown in FIG. 3, the cover 14 is in its open position, the cartridge 50 can be inserted into the cover 14 from the washing compartment 4. For securing and fixing in position, the cover 14 has two symmetrically arranged retaining clips 17 that are L-shaped and matched to the size of the cartridge 50 so that the retaining clips 17 will engage around the cartridge 50 and secure it when it has been inserted. A support surface 30 is furthermore molded onto the cover 14 so that the cartridge 50 will come to rest in a defined position. Closing of the cover 14 will cause the cartridge to be moved into a holding space 15 of the detergent dispenser 11 and pressed into its final position by means of lugs and/or projections possibly present on the detergent dispenser's housing.

As can readily be seen from the cross-sectional view shown in FIG. 3, the outer circumference of the housing 12 of the detergent dispenser 11 has a fold. The fold serves to accommodate a gasket 32 that is inserted between the fold and the container wall 7. The ingress of water or moisture toward the rear side of the container wall 7 will be prevented thereby.

Apart from the receptacle for the cartridge the detergent dispenser II has a chamber 27 for holding a solid detergent. The solid detergent can be, for example, a 3-in-1 tab that is placed into the chamber 27 when there is no cartridge 50 in the holding space 15 or one that is empty. Providing the chamber 27 for holding a solid detergent will enable the dishwasher to be used even when the cartridge 50 is empty and there is no filled cartridge available.

The chamber 27 has, as can be seen in FIG. 3, an opening 31 that is linked to the dishwasher's surrounding area. The opening 31 can for that purpose be linked to the surrounding area by way of channels, not shown in the figures, which extend along the rear side of the container wall 7. The detergent-dosing system thereby integrates the functionality of what is termed an "expansion opening" that serves to duct away the overpressure occurring in the washing compartment if, for example, the dishwasher containing already heated washing liquor is opened by the user during a washing cycle then closed again. The overpressure occurring at that instant can then be ducted away to the surrounding area via the chamber 27 and opening 31.

Integrating the expansion opening into the detergent-dosing system and the opportunity to be able to make all detergents and operating means for operating the dishwasher available by means of the detergent-dosing system result in a much simpler structural design compared with conventional dishwashers. In particular it is necessary to provide just one opening for the detergent-dosing system 10 in the dishwasher's washing compartment. It is hence possible to dispense with further openings of the type hitherto needed for providing the expansion opening and/or adding device. The dishwasher can consequently be produced in fewer steps. What is further dispensable is the need to provide each of the openings for one of the cited functional parts with an effort-intensive gasket. It is thereby possible overall to produce a more economical dishwasher.

Figure 4:
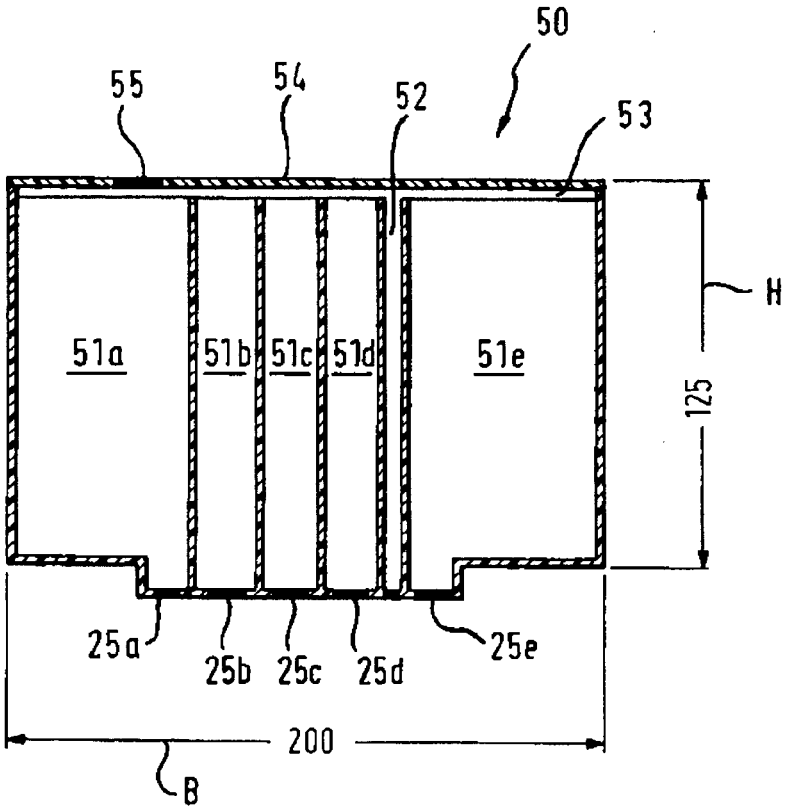
FIG. 4 shows an exemplary embodiment of a cartridge for use in an inventive detergent-dosing system.

An exemplary embodiment of the inventive cartridge 50 is shown in FIG. 4. The cartridge 50 has only by way of example five chambers 51*a*, 51*b*, 51*c*, 51*d* and 51*e* for holding in each case a detergent or detergent mixture. The size of the individual chambers 51*a* to 51*e* is therein preferably dimensioned in keeping with the volume necessary during a predefined number of washing cycles. The volume of the different detergents in the chambers 51*a* to 51*e* is preferably dimensioned such that all the chambers 51*a* to 51*e* will have been completely emptied after a specific number of washing cycles, preferably between 20 and 40, preferably further around 30. Each of the chambers 51*a* to 51*e* is provided with a seal 25*a* to 25*e* in the form of, for example, a membrane, a film or an elastomer. The membrane made of, for example, a rubber material seals the individual chambers 51*a* to 51*e* tightly so that no detergent will be able to escape from the cartridge 50 while it is being stored and transported. The membranes will be pierced by hollow needles 21 (see FIG. 3) arranged correspondingly in the detergent dispenser 11 when the cartridge 50 is inserted into the detergent dispenser 11 so that detergent can be dispensed into the washing compartment in keeping with a corresponding dosing device. It is further ensured owing to the elastic properties of a membrane, film or elastomer that the opening produced by piercing will close again automatically when the cartridge is removed from the detergent dispenser 10. That will ensure that any detergent residues remaining in the cartridge when it is handled normally will be unable to escape.

The cartridge is made preferably of a plastic material and has a width B of approximately 200 mm, a height H of approximately 125 mm and a depth of approximately 25 mm. The volume of the different chambers can, given those dimensions, be dimensioned such that the desired 20 to 40 washing cycles can be executed using one cartridge.

Alongside the chambers 51*a* to 51*e* the cartridge 50 has a further chamber 52 functionally linked to one or more ventilating channels 53. The ventilating channel(s) 53 is/are linked in turn to the different chambers 51*a* to 51*e*. It is in that way ensured that no negative pressure that would make detergent adding difficult or incorrect can build up in the chambers 51*a* to 51*e* as they are increasingly emptied. The ventilating channels 53 are located preferably in a cover 54 that will have been placed on top of the cartridge's housing when the individual chambers 51*a* to 51*e* have been filled with the respective detergents. The cover 54 can have an overpressure valve 55 that may be necessary in the case of certain detergent constituents.

Because the detergents contained in the cartridge 50 will be added to the washing compartment, or more precisely to the washing liquor being circulated in the washing compartment, only gradually in doses within the scope of a plurality of washing cycles, they will be exposed to considerable absolute temperatures and temperature variations with each washing cycle. To prevent the detergents' properties from changing over time owing to that, at least one housing wall 13, oriented toward the washing compartment, of the cartridge 50 and/or the cover 14, oriented toward the washing compartment, of the detergent-dosing system 10 is/are made of an insulating material or else surrounded by an insulation 33. That will limit a flow of heat from the washing compartment toward the detergent-dosing system or the detergents held in store in the cartridge so that the long-term stability of the detergents used will be ensured. The insulation 33 can be formed by means of a volume of gas located in the cover or relevant housing section of the cartridge. Said volume of gas producing the insulation can be emplaced while the cover or cartridge is being produced. The method employed for that is known as the gas internal pressure process.

Furthermore provided in the housing 12 of the detergent dispenser 11 are outlets 19*a* to 19*e*. The outlets 19*a* to 19*e* feed in each case into a dosing chamber 20*a* to 20*e*. The dosing chambers are each linked to an assigned chamber of the cartridge via the hollow needles.

Located in each of the dosing chambers is a conveying device (not presented in more detail) that causes a predefined amount of detergent to be conveyed into the washing compartment.

The detergent can therein be conveyed exclusively exploiting gravity, but the conveying device can also be constructed on the principle of a pump so that detergents will by means of a corresponding negative pressure be conveyed from the detergent chamber into the dosing chamber and by means of a corresponding overpressure from the dosing chamber 20*a* into the washing compartment.

List of Reference Symbols

1 Dishwasher
2 Housing
3 Door
4 Washing compartment
5 Dishwasher basket
6 Dishwasher basket
7 Container wall
8 Front side of the door
10 Detergent-dosing system
11 Detergent dispenser
12 Housing
13 Housing wall
14 Cover
15 Holding space
16 Retention device
17 Retaining clip
19*a*-19*e* Outlet
20*a*-20*e* Dosing chamber
21*a*-21*e* Hollow needle
25*a*-25*e* Membrane
27 Chamber for solid detergent
30 Stop/support surface
31 Opening
32 Gasket
33 Insulation
50 Cartridge
51*a*-51*e* Chamber for detergent
52 Chamber for venting
53 Ventilating channel

54 Cover
55 Overpressure valve
H Height
B Width

The invention claimed is:

1. A cartridge for use in a detergent-dosing system of a domestic dishwasher having a washing compartment and a detergent dispenser, the detergent dispenser being configured with a holding space for holding the cartridge, the cartridge comprising:

at least two chambers, each chamber configured to hold a cleaning liquid separate from any cleaning liquid held by another one of the chambers;

at least two seals, each seal being fluidly connected to a respective one of the chambers for substantially precluding discharge of a cleaning liquid retained by the respective chamber, each seal being an elastic membrane or an elastic film, and each seal being configured to be opened at least once for a discharge of cleaning liquid from the respective chamber and to be closed at least once after being opened;

a common cover covering the at least two chambers, the common cover including a ventilation channel in the cover extending across the at least two chambers; and a ventilating chamber disposed in a housing of the cartridge between two of the at least two chambers, the ventilation chamber being connected with the at least two chambers via the ventilation channel, the ventilation chamber being without an openable closure, wherein each seal is configured for respectively opening automatically by a piercing of the elastic membrane or the elastic film of the seal when the cartridge is inserted into the detergent container and closing automatically by the elastic property of the elastic membrane or elastic film closing the piercing when the cartridge is removed from the detergent dispenser.

2. The cartridge according to claim 1 wherein each seal is located at a place corresponding to an opening means of the detergent dispenser when the cartridge is inserted into the detergent dispenser, wherein the seal is configured to be in an opened position in which the cleaning liquid can be added to the washing compartment of the dishwasher during a washing cycle by the detergent-dosing system when the cartridge is in the detergent dispenser.

3. The cartridge according to claim 1 wherein the cartridge is configured such that when the cartridge is inserted into the detergent dispenser the seal will be located at a place corresponding to a hollow needle of the detergent dispenser so that the seal will be pierced by the needle.

4. The cartridge according to claim 1 wherein a cleaning liquid is stored in one of the at least two chambers of the cartridge.

5. The cartridge according to claim 1 and further comprising at least one conveying device for conveying at least one cleaning liquid into the washing compartment of the domestic dishwasher.

6. The cartridge according to claim 5 wherein the cartridge has a number of the conveying devices and a number of the at least two chambers, and the number of conveying devices equals the number of the at least two chambers.

7. The cartridge according to claim 1 wherein the cartridge has a mechanical coding configured for interaction with a counter-coding on a receptacle side of the holding space for defining an installed position of the cartridge in the domestic dishwasher.

8. The cartridge according to claim 1 wherein the cartridge has a longitudinal extent along a first direction.

9. The cartridge according to claim 8 wherein the cartridge is longer along the first direction than it is along a second direction of the cartridge, wherein the second direction is non-parallel to the first direction.

10. The cartridge according to claim 8 wherein the chambers of the cartridge are arranged adjacent one another along the first direction.

11. The cartridge according to claim 1 wherein at least one of the chambers has its contents selected from the group consisting of enzymes, bleaching agents, bleach activators, dispersing and complexing agents, tensides, alkali-bearing substances and biocides.

12. A domestic dishwasher, comprising:

a washing compartment;

a detergent-dosing system having a detergent dispenser, the detergent dispenser having a holding space; and a cartridge, the cartridge having at least two chambers, each chamber configured to hold a cleaning liquid separate from any cleaning liquid held by another one of the chambers;

at least two seals, each seal being fluidly connected to a respective one of the chambers for substantially precluding discharge of a cleaning liquid retained by the respective chamber, each seal being elastic membrane or an elastic film, and each seal being configured to be opened at least once for a discharge of cleaning liquid from the respective chamber and to be closed at least once after being opened;

a common cover covering the at least two chambers, the common cover including a ventilation channel in the cover extending across the at least two chambers; and a ventilating chamber disposed in a housing of the cartridge between two of the at least two chambers, the ventilation chamber being connected with the at least two chambers via the ventilation channel, the ventilation chamber being without an openable closure wherein the holding space holds the cartridge, and each seal is configured for respectively opening automatically by a piercing of the elastic membrane or the elastic film of the seal when the cartridge is inserted into the detergent container and closing automatically by the elastic property of the elastic membrane or the elastic film closing the piercing when the cartridge is removed from the detergent dispenser.

13. The domestic dishwasher according to claim 12 wherein the detergent-dosing system has a dosing chamber that is arranged such that a fluid connection between the cartridge and the dosing chamber is established by a hollow needle.

14. The domestic dishwasher according to claim 12 wherein the detergent-dosing system has an opening assembly formed by at least one hollow needle configured to pierce the seal when the cartridge is inserted into the holding space.

15. The domestic dishwasher according to claim 12 wherein a retention device for securing the cartridge and fixing it in position is provided on the detergent dispenser.

16. The domestic dishwasher according to claim 15 wherein the retention device is formed as a receptacle formed on a cover of the detergent dispenser, configured for movement between an open position and a closed position for placing the holding space in a closed position.

17. The domestic dishwasher according to claim 12 and further comprising a positioning device for positioning the cartridge in the detergent dispenser.

18. The domestic dishwasher according claim 12 wherein the detergent-dosing system has at least one outlet that is functionally linked to a washing compartment and through which a specified amount of detergent can be ducted to a washing fluid during a washing cycle, with the at least one outlet being provided on the detergent dispenser.

19. The domestic dishwasher according to claim 18 and further comprising at least one outlet disposed on a housing section of the detergent dispenser, wherein the housing section is located in the direction of gravity below the holding space.

20. The domestic dishwasher according to claim 18 wherein the at least one outlet of the detergent-dosing system feeds into a dosing chamber that is functionally linked to the detergent.

21. The domestic dishwasher according to claim 20 wherein the dosing chamber is assigned a conveying device by which the detergent can be ducted to the washing compartment from the cartridge.

22. The domestic dishwasher according to one of claim 12 wherein the detergent-dosing system has a solid detergent chamber for holding a solid detergent.

23. The domestic dishwasher according to claim 12 wherein the detergent-dosing system is located in a side wall of the washing compartment between a top basket and a bottom basket.

24. The domestic dishwasher according claim 12 wherein the detergent-dosing system is located on a door and configured to swivel with respect to the washing compartment of the domestic dishwasher.

25. The domestic dishwasher according to claim 24 wherein the detergent-dosing system is embodied on the door such that the detergent dispenser will be fitted with the cartridge from an edge surface of the door.

26. The domestic dishwasher according to claim 25 wherein the detergent dispenser is fitted with the cartridge in at least one of a region of an inner door and the region of a cover panel on the door.

27. A detergent-dosing system for use in a domestic dishwasher, the system comprising:

a cartridge; and a detergent dispenser that has at least one holding space for holding the cartridge, wherein the cartridge has at least two chambers, each chamber configured to hold a cleaning liquid separate from any cleaning liquid held by another one of the chambers;

at least two seals, each seal being fluidly connected to a respective one of the chambers for substantially precluding discharge of a cleaning liquid retained by the respective chamber, each seal being an elastic membrane or an elastic film, and each seal being configured to be opened at least once for a discharge of cleaning liquid from the respective chamber and to be closed at least once after being opened;

a common cover covering the at least two chambers, the common cover including a ventilation channel in the cover extending across the at least two chambers; and a ventilating chamber disposed in a housing of the cartridge between two of the at least two chambers, the ventilation chamber being connected with the at least two chambers via the ventilation channel, the ventilation chamber being without an openable closure, and each seal is configured for respectively opening automatically by a piercing of the elastic membrane or the elastic film of the seal when the cartridge is inserted into the detergent container and closing automatically by the elastic property of the elastic membrane or elastic film closing the piercing when the cartridge is removed from the detergent dispenser.

* * * * *